US012723293B2

(12) United States Patent
Watanabe et al.

(10) Patent No.: US 12,723,293 B2
(45) Date of Patent: Sep. 1, 2026

(54) METHOD OF PRODUCING GRAIN-ORIENTED ELECTRICAL STEEL SHEET AND ANNEALING SEPARATOR USED FOR SAME

(71) Applicant: JFE STEEL CORPORATION, Tokyo (JP)

(72) Inventors: Makoto Watanabe, Tokyo (JP); Takuya Yamada, Tokyo (JP); Takashi Terashima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 358 days.

(21) Appl. No.: 18/263,707

(22) PCT Filed: Feb. 2, 2022

(86) PCT No.: PCT/JP2022/004122
§ 371 (c)(1),
(2) Date: Aug. 1, 2023

(87) PCT Pub. No.: WO2022/168887
PCT Pub. Date: Aug. 11, 2022

(65) Prior Publication Data

US 2024/0240292 A1 Jul. 18, 2024

(30) Foreign Application Priority Data

Feb. 4, 2021 (JP) ..... 2021-016908

(51) Int. Cl.

| | |
|---|---|
| ***C22C 38/02*** | (2006.01) |
| ***C21D 6/00*** | (2006.01) |
| ***C21D 8/00*** | (2006.01) |
| ***C21D 8/12*** | (2026.01) |
| ***C21D 8/1216*** | (2026.01) |
| ***C21D 8/1244*** | (2026.01) |
| ***C21D 8/1277*** | (2026.01) |
| ***C21D 9/46*** | (2006.01) |
| ***C22C 38/04*** | (2006.01) |
| ***C22C 38/12*** | (2006.01) |
| ***C22C 38/14*** | (2006.01) |

(52) U.S. Cl.
CPC ..... *C22C 38/02* (2013.01); *C21D 6/008* (2013.01); *C21D 8/00* (2013.01); *C21D 8/1222* (2013.01); *C21D 8/1233* (2013.01); *C21D 8/1266* (2013.01); *C21D 8/1272* (2013.01); *C21D 8/1283* (2013.01); *C21D 9/46* (2013.01); *C22C 38/04* (2013.01); *C22C 38/12* (2013.01); *C22C 38/14* (2013.01); *C21D 2201/05* (2013.01)

(58) Field of Classification Search
None
See application file for complete search history.

(56) References Cited

U.S. PATENT DOCUMENTS

| | | | |
|---|---|---|---|
| 2015/0187473 | A1 | 7/2015 | Imamura et al. |
| 2021/0246524 | A1 | 8/2021 | Nakamura et al. |

FOREIGN PATENT DOCUMENTS

| | | | | |
|---|---|---|---|---|
| JP | S5985820 | A | | 5/1984 |
| JP | H09184017 | A | | 7/1997 |
| JP | H1053818 | A | | 2/1998 |
| JP | H11158557 | A | | 6/1999 |
| JP | 2003253334 | A | | 9/2003 |
| JP | 2005256158 | A | | 9/2005 |
| JP | 2006193798 | A | | 7/2006 |
| JP | 2007177298 | A | * | 7/2007 |
| JP | 2008115421 | A | | 5/2008 |
| JP | 2011074453 | A | | 4/2011 |
| JP | 2019085632 | A | | 6/2019 |
| JP | 2020122210 | A | | 8/2020 |
| WO | 2008047999 | A1 | | 4/2008 |
| WO | 2020027218 | A1 | | 2/2020 |

OTHER PUBLICATIONS

Apr. 19, 2022, International Search Report issued in the International Patent Application No. PCT/JP2021/004122.
Jun. 6, 2023, Notification of Reasons for Refusal issued by the Japan Patent Office in the corresponding Japanese Patent Application No. 2022-528168 with English language Concise Statement of Relevance.
Chen Ling et al., The Effects of Vnadium and Titanium on the Grain-Oriented Silicon Steel, Metalurgia International, 2013, vol. XVIII, No. 6, XP093155849.
Jun. 3, 2024, the Extended European Search Report issued by the European Patent Office in the corresponding European Patent Application No. 22749758.3.
Sep. 22, 2025, Office Action issued by the Korean Intellectual Property Office in the corresponding Korean Patent Application No. 10-2023-7026336 with English language concise statement of relevance.
Mar. 12, 2026, Office Action issued by the China National Intellectual Property Administration in the corresponding Chinese Patent Application No. 202280012381.8 with English language search report.
Apr. 8, 2026, Office Action issued by the Ministry of Intellectual Property in the corresponding Korean Patent Application No. 10-2023-7026336 with English language concise statement of relevance.

* cited by examiner

*Primary Examiner* — Anthony M Liang
(74) *Attorney, Agent, or Firm* — KENJA IP LAW PC

(57) ABSTRACT

To provide a method of producing a grain-oriented electrical steel sheet whereby greater purification of an inhibitor-strengthening element can be promoted by improvement of an annealing separator and, as a result, iron loss can be effectively improved. The annealing separator contains 1 to 10 parts by mass of a composite oxide, relative to 100 parts by mass of MgO, the composite oxide containing at least one selected from a Group 1: Fe, Mn, Al and Ca, and at least one of a Group 2: Zr, Ta, Mo and Nb.

4 Claims, No Drawings

METHOD OF PRODUCING GRAIN-ORIENTED ELECTRICAL STEEL SHEET AND ANNEALING SEPARATOR USED FOR SAME

TECHNICAL FIELD

This disclosure relates to a method of producing a grain-oriented electrical steel sheet used for iron cores, etc. of transformers and other electrical equipment and relates in particular to a method of producing a grain-oriented electrical steel sheet with excellent magnetic properties and film properties caused by improvements to an annealing separator applied to the steel sheet after decarburization annealing.

This disclosure also relates to the annealing separator used in the above-mentioned method of producing a grain-oriented electrical steel sheet.

BACKGROUND

The production process for a grain-oriented electrical steel sheet generally involves subjecting a steel slab to hot rolling, followed by cold rolling, and then decarburization annealing followed by final annealing for secondary recrystallization. Of these processes, secondary recrystallization occurs during final annealing, producing coarse crystal grains with an easy magnetization axis aligned in the rolling direction of the steel sheet.

Since final annealing is performed over a long time, an annealing separator composed mainly of MgO is usually applied to a steel sheet before annealing to prevent the steel sheet from sticking. In addition to its role as an annealing separator, the MgO also works to form a forsterite film by reacting with an $SiO_2$-based oxide layer formed during decarburization annealing.

In addition, various characteristics of the annealing separator significantly change the product characteristics of the grain-oriented electrical steel sheet because they exert an effect on a steel substrate portion, such as formation and growth behavior of precipitates and growth behavior of crystal grains. For example, in a case where too much moisture is brought in when slurrying the annealing separator, the steel sheet oxidizes, magnetic properties deteriorate, and point-like defects form in the film. It is also known that impurities contained in the annealing separator can change secondary recrystallization behavior and film formation behavior by penetrating into the steel during annealing, etc.

In recent years, along with a growing need for energy conservation, there has been a growing demand for further improvement of magnetic properties of grain-oriented electrical steel sheets. As one measure against this problem, a technique has been proposed to add elements, such as Ti, Nb, and Ta, to the chemical composition of steel to strengthen grain growth inhibition.

However, when these elements are added, although oriented secondary recrystallized grains can be generated during the grain growth process, a problem occurs wherein these elements are not purified. Normally, secondary recrystallization annealing is followed by purification annealing at about 1200° C. During this purification annealing, AlN, MnS, and other substances are decomposed as inhibitors and removed from steel. However, in a case where the chemical composition of steel contains strengthening elements such as Ti, Nb, and Ta mentioned above, the steel is not sufficiently purified by this purification annealing, and the strengthening elements precipitate and remain in the steel as nitrides and carbides. When such residuals occur, these precipitates prevent magnetic domain walls from moving when the product is used, increasing iron loss and preventing the desired energy-saving effect from being achieved.

In response to this problem, several techniques have been proposed to improve the purification of inhibitor elements. For example, JP 2008-115421 A (PTL 1) proposes a method of smoothly progressing decarburization by performing open coil annealing in a humid atmosphere after completion of secondary recrystallization.

JP H11-158557 A (PTL 2) proposes a method of promoting purification by reducing a nitrogen partial pressure in the atmosphere of final annealing.

JP 2006-193798 A (PTL 3) discloses a method of conducting a specific temperature range during steel sheet cooling after final annealing in an atmosphere of hydrogen and inert gas.

JP H09-184017 A (PTL 4) discloses a method of performing purification annealing in an $H_2$—$N_2$ mixed atmosphere.

CITATION LIST

Patent Literature

PTL 1: JP 2008-115421 A
PTL 2: JP H11-158557 A
PTL 3: JP 2006-193798 A
PTL 4: JP H09-184017 A

SUMMARY

Technical Problem

However, although the method described in PTL 1 can effectively decarburize steel, elements such as Nb and Ta still remain in the steel, and these remaining elements that remain in the steel may combine with a small amount of nitrogen, oxygen, carbon, etc. in the steel to cause magnetic aging during product use.

Although the method described in PTL 2 improved the purification of nitrogen, elements such as Nb and Ta still remain in the steel, and these elements sometimes combine with carbon and other elements to cause magnetic aging.

Although the method described in PTL 3 can prevent nitriding during cooling in final annealing, elements such as Nb and Ta remain and still cause magnetic aging.

Although the method described in PTL 4 can prevent Ti from penetrating into steel by fixing Ti in the coating, the effect is still limited because it cannot purify Ti, Nb, and other elements that were originally present in the steel substrate.

In addition to these, various other methods for improving purification defects and reducing iron loss have been proposed, but none of them are sufficient and it has been difficult to achieve the desired characteristics.

In view of the aforementioned circumstances, it would be helpful to propose a method of producing a grain-oriented electrical steel sheet whereby greater purification of an inhibitor-strengthening element can be promoted by improvement of an annealing separator and, as a result, iron loss can be effectively improved, together with the above improved annealing separator.

Solution to Problem

The features of our method are as follows:

1. A method of producing a grain-oriented electrical steel sheet, the method comprising: subjecting a slab for grain-oriented electrical steel sheets to heating, hot rolling, cold rolling once or twice or more with intermediate annealing performed therebetween, primary recrystallization annealing, followed by application of an annealing separator and then final annealing, wherein the slab for grain-oriented electrical steel sheets comprises a chemical composition containing (consisting of) C in an amount of 0.01 mass % to 0.09 mass %, Si in an amount of 2.00 mass % to 4.00 mass %, Mn in an amount of 0.03 mass % to 0.25 mass %, and at least one selected from a group consisting of Nb, V and Ti in a total amount of 0.002 mass % to 0.025 mass %, with the balance being Fe and inevitable impurities, wherein the annealing separator contains MgO as a main agent and 1 to 10 parts by mass of a composite oxide, relative to 100 parts by mass of MgO, the composite oxide containing at least one selected from a Group 1 (first group): Fe, Mn, Al and Ca, and at least one selected from a Group 2 (second group): Zr, Ta, Mo and Nb.

2. The method of producing a grain-oriented electrical steel sheet according to aspect 1, wherein a maximum arrival temperature in the final annealing is 1210° C. or higher.

3. The method of producing a grain-oriented electrical steel sheet according to aspect 1 or 2, wherein the chemical composition further contains at least one selected from a group consisting of Al: 0.004 mass % to 0.040 mass %, N: 0.002 mass % to 0.010 mass %, S: 0.002 mass % to 0.030 mass %, Se: 0.002 mass % to 0.030 mass %, Ni: 0.01 mass % to 1.50 mass %, Cr: 0.01 mass % to 0.50 mass %, Cu: 0.01 mass % to 0.50 mass %, P: 0.005 mass % to 0.100 mass %, Sb: 0.005 mass % to 0.100 mass %, Sn: 0.005 mass % to 0.100 mass %, Bi: 0.001 mass % to 0.050 mass %, Mo: 0.005 mass % to 0.100 mass %, B: 0.0002 mass % to 0.0025 mass %, and Te: 0.0005 mass % to 0.0100 mass %.

4. An annealing separator for use in the method of producing a grain-oriented electrical steel sheet according to any one of aspects 1 to 3, wherein the annealing separator contains 1 to 10 parts by mass of a composite oxide, relative to 100 parts by mass of MgO, the composite oxide containing at least one selected from a Group 1 (first group): Fe, Mn, Al and Ca, and at least one selected from a Group 2 (second group): Zr, Ta, Mo and Nb.

Advantageous Effect

According to the present disclosure, it is possible to produce a grain-oriented electrical steel sheet with good magnetic properties because inhibitor-strengthening elements can be sufficiently purified, thereby contributing significantly to improving the quality of the grain-oriented electrical steel sheet.

DETAILED DESCRIPTION

We conducted various experiments to improve the purification of a grain-oriented electrical steel sheet which uses inhibitor-strengthening elements. As a result, we newly found that the purification of inhibitor-strengthening elements in particular is significantly improved by using a composite oxide containing certain elements as a component of an annealing separator.

The following is a description of the experiments that led to our method.

A steel slab containing C: 0.07 mass % (hereafter, the "mass %" of the steel sheet components is represented simply with "%"), Si: 3.3%, Mn: 0.07%, Al: 0.02%, N: 0.008%, Se: 0.02%, and Nb: 0.005%, with the balance being substantially Fe was heated and soaked at a temperature of 1380° C. for 30 minutes, then hot rolled to a thickness of 2.2 mm, and then subjected to cold rolling twice, with intermediate annealing performed therebetween, at 1050° C. for 1 minute to obtain a cold-rolled sheet with a final sheet thickness of 0.23 mm.

The cold-rolled sheet was subject to decarburization annealing, then coated with an annealing separator composed mainly of MgO and dried. In this case, various additives were mixed with the annealing separator with varying amounts relative to 100 parts by mass of MgO. Then, as final annealing, secondary recrystallization annealing was performed at 890° C. for 40 hours, followed by a further purification annealing at 1210° C. for 10 hours.

Afterward, the unreacted annealing separator was then removed, a coating of a mixture composed of primary aluminum phosphate and colloidal silica was applied, and flattening annealing was carried out at 850° C. for 1 minute while baking to obtain a product steel sheet.

Magnetic property measurements were performed on the steel sheet in accordance with the JIS C 2550 method. After removing the coating from the resulting steel sheet, a quantitative analysis of Nb, N, and C was performed. The analytical methods used were the absorption spectrophotometric method for Nb and N and the infrared absorption method after combustion for carbon (the same applies to the following experiments and examples).

The results thus obtained are listed in Table 1.

TABLE 1

| Additive | Amount (Mass part) | $B_8$ (T) | $W_{17/50}$ (W/kg) | Nb (%) | N (%) | C (%) |
|---|---|---|---|---|---|---|
| No additive | | 1.93 | 0.81 | 0.005 | 0.004 | <0.001 |
| $MnTa_2O_6$ | 1 | 1.95 | 0.75 | <0.001 | <0.001 | <0.001 |
| | 3 | 1.95 | 0.74 | <0.001 | <0.001 | <0.001 |
| | 9 | 1.95 | 0.75 | <0.001 | <0.001 | <0.001 |
| $TaO_2$ | 1 | 1.94 | 0.77 | 0.004 | 0.002 | <0.001 |
| | 3 | 1.95 | 0.77 | 0.003 | 0.002 | <0.001 |
| | 9 | 1.95 | 0.78 | 0.004 | 0.003 | <0.001 |
| MnO | 1 | 1.95 | 0.78 | 0.005 | 0.004 | <0.001 |
| | 3 | 1.95 | 0.78 | 0.004 | 0.003 | <0.001 |
| | 9 | 1.94 | 0.79 | 0.005 | 0.004 | <0.001 |
| $Mn_2SiO_4$ | 1 | 1.94 | 0.79 | 0.005 | 0.003 | <0.001 |
| | 3 | 1.95 | 0.78 | 0.004 | 0.003 | <0.001 |
| | 9 | 1.95 | 0.77 | 0.004 | 0.002 | <0.001 |
| $MnSO_4$ | 1 | 1.94 | 0.79 | 0.005 | 0.004 | <0.001 |
| | 3 | 1.94 | 0.77 | 0.004 | 0.003 | <0.001 |
| | 9 | 1.95 | 0.78 | 0.005 | 0.004 | <0.001 |

It can be understood from the same table that the addition of $MnTa_2O_6$ effectively reduces each of the Nb, N, and C elements in the steel sheet and that an excellent purification effect can be obtained. In addition, good values for magnetic properties can be obtained accordingly. In contrast, the addition of Ta oxide, Mn oxide, or Mn compounds that are not composite oxides was not significantly different from the case where no additives were added to the annealing separator, and little purification effect was observed.

The cause of this improvement in purification by the addition of composite oxides containing Mn, Ta, etc. is not clear, but we think as follows.

Nb binds with N during final annealing and precipitates as a nitride and has the effect of strengthening grain growth inhibiting capability. Such an action produces a secondary recrystallized microstructure that is highly aligned with the GOSS orientation.

In this case, secondary recrystallized grains occur at about 800° C. to 900° C. Further, Nb nitride decomposes and separates into solute Nb and nitrogen around 900° C. Of these, nitrogen is purified by diffusion into the surface layer of the steel sheet and then by gas phase release. On the other hand, although solute Nb can be expected to be oxidized by the hydrated water content of the annealing separator MgO to become $Nb_2O_5$ and purified, in reality, $SiO_2$ is preferentially formed due to the large amount of Si in the steel, which has a higher ionization tendency than Nb, and the formation of $Nb_2O_5$ is suppressed. Therefore, for Nb purification, it is necessary to fix Nb by methods other than oxidation. This is because in a case where Nb is not sufficiently purified, N and C re-enter the steel during cooling in final annealing and subsequent flattening annealing to form niobium nitride and niobium carbide.

In this case, $MnTa_2O_6$, which was effective in Nb purification, is orthorhombic and has the same crystal structure as $MnNb_2O_6$. Therefore, Ta and Nb can be mutually substituted. The free energy of $MnTa_2O_6$ is reduced by forming a solute as $Mn(Ta,Nb)_2O_6$. Therefore, it is thought that Nb substitutes for Ta in $MnTa_2O_6$ in the annealing separator, forms a solute as $Mn(Ta,Nb)_2O_6$, and diffuses from the steel sheet surface layer into the annealing separator, thus increasing purification.

The substituted Ta does not penetrate into the steel and exists as Ta ions in the annealing separator, which, together with $MnTa_2O_6$ and $Mn(Ta,Nb)_2O_6$, are either purified by final annealing or removed together with the removal of the unreacted annealing separator.

Next, the reason for the limitations to the annealing separator for the grain-oriented electrical steel sheet in our method is described.

[Annealing Separator]

The main agent of the annealing separator in this method is MgO. That is, at least 50 mass % or more of the annealing separator is MgO.

The above annealing separator contains a compound oxide which is an oxide of elements being a combination of at least one selected from the following Group 1 with at least one selected from the Group 2, Group 1: Fe, Mn, Al, and Ca and Group 2: Zr, Ta, Mo, and Nb.

By using any of such composite oxides, it is possible to add inhibitor-strengthening elements such as Nb, Ti, Ta, and V to steel and still purify it with final annealing.

As mentioned above, it is important that such composite oxides have a crystal structure in which inhibitor-strengthening elements such as Nb, Ti, Ta, and V can be mutually substituted. Compounds having such a crystal structure may be oxides of elements being a combination of at least one selected from the Group 1 with at least one selected from the Group 2, and such compounds are suitable from the viewpoints of ease of handling and obtaining.

Specifically, examples include $(Fe_x, Mn_{1-x})MoO_4$, $(Fe_x, Mn_{1-x})_2Mo_3O_{12}$, $Al_2(MoO_4)_3$, $(Fe_x,Mn_{1-x})(Ta_y,Nb_{1-y})O_3$, $(Fe_x,Mn_{1-x})_2ZrO_5$ and $Al_2Zr_3O_9$. In this case, x and y can take any values in the range of 0 to 1 because Fe and Mn, and Nb and Ta are mutually capable of fully forming a solute. Other suitable composite oxides are $(Fe_x, Mn_{1-x})(Ta_y, Nb_{1-y})_2O_6$, $CaZrO_3$, $Al_2Mo_3O_{12}$, and $CaMoO_4$ which easily form a solute in inhibitor-strengthening substances.

The content of such a composite oxide in the annealing separator is 1 to 10 parts by mass relative to 100 parts by mass of MgO, preferably 2 parts by mass or more, and more preferably 3 parts by mass or more. The content of such a composite oxide is preferably 9 parts by mass or less and more preferably 8 parts by mass or less. In a case where less than 1 mass part is used relative to 100 mass parts of MgO, no purification effect is obtained, and in a case where more than 10 mass parts are used, the MgO ratio decreases, resulting in poor film formation.

The annealing separator according to our method can be further supplemented with the following additives from other perspectives such as magnetic properties and film properties.

Specifically, such additives may be borates, carbonates, sulfates, oxides, hydroxides, nitrates, halides and phosphates, etc. of conventionally known Li, Na, K, Mg, Sr, Ca, Ba, Ti, V, Cr, Mn, Fe, Co, Ni, Zn, Si, Cu, Sb, Pb, Sn, Al, Bi, Nb, Mo, W and lanthanides. These can be used alone or together in combinations of two or more. The amounts of such additives are preferably 0.01 to 15 mass parts relative to 100 mass parts of MgO. Too little is not effective, while too much promotes excessive film formation or excessive strengthening of only the inhibitor in the surface layer which in turn can easily degrade the magnetic properties and film.

In our production method, the annealing separator is applied to the surface of the steel sheet in accordance with conventional methods. The most common method is to slurry the annealing separator with an appropriate amount of water, apply it with a roll coater, and dry. Other methods, such as electrostatic coating methods and spray coating, die coating, or other coater application methods are also acceptable.

The amount of annealing separator applied can be in accordance with the conventional method, for example, 0.5 $g/m^2$ to 30 $g/m^2$ for both sides by weight without water.

The amount of annealing separator herein is expressed in terms of weight for both sides without water.

Next, the reasons for the limitations to and suitable conditions for the chemical composition and production conditions of the steel material are described.

[Chemical Composition of Steel Slab]

C: 0.01% to 0.09%

C is an element that improves the texture, and in a case where the content is outside the above range, no good texture is formed. Therefore, the content thereof is 0.01% or more and 0.09% or less. The content thereof is preferably 0.02% or more. The content thereof is more preferably 0.03% or more. The content thereof is preferably 0.08% or less. The content thereof is more preferably 0.07% or less.

Si: 2.00% to 4.00%

Si is an element that improves magnetic properties, and a content of less than 2.00%, weakens the reducing effect of iron loss, whereas a content exceeding 4.00% impairs cold rolling manufacturability. Therefore, the content thereof is 2.00% or more and 4.00% or less. The content thereof is preferably 2.30% or more. The content thereof is more preferably 2.50% or more. The content thereof is preferably 3.80% or less. The content thereof is more preferably 3.50% or less.

Mn: 0.03% to 0.25%

Mn is an element necessary to improve the hot workability of steel. The above effect is not sufficient when the content is less than 0.03%, whereas the magnetic flux density of the product sheet decreases when the content exceeds 0.25%. Therefore, the Mn content is in the range of 0.03% to 0.25%. The Mn content is preferably 0.06% or more. The Mn content is more preferably 0.08% or more. The Mn content is preferably 0.22% or less. The Mn content is more preferably 0.20% or less.

Nb, V, Ti: Any One or More Totaling 0.002% to 0.025%

Nb, V, and Ti are elements which are used to strengthen inhibitors. In a case where the total of the contents is less than 0.002%, there is no effect, and in a case where the total exceeds 0.025%, it is difficult to sufficiently purify these elements even by applying our method. The total of these contents is preferably 0.005% or more and more preferably 0.010% or more. The total of these contents is preferably 0.020% or less and more preferably 0.018% or less.

In addition to these components, AlN, MnS and MnSe are well known as conventional inhibitor-forming components. Any of these may be used in our method, and two or more may be used in combination.

In addition, any one or more of Ni, Cr, Cu, P, Sb, Sn, Bi, Mo, B, and Te can be used as auxiliary inhibitors in our method. These elements do not form precipitates and either do not require purification or can be easily purified.

The content of each of the above elements is as follows: Al: 0.004% to 0.040%, N: 0.002% to 0.010%, S: 0.002% to 0.030%, Se: 0.002% to 0.030%, Ni: 0.01% to 1.50%, Cr: 0.01% to 0.50%, Cu: 0.01% to 0.50%, P: 0.005% to 0.100%, Sb: 0.005% to 0.100%, Sn: 0.005% to 0.100%, Bi: 0.001% to 0.050%, Mo: 0.005% to 0.100%, B: 0.0002% to 0.0025%, and Te: 0.0005% to 0.0100%. The Mn content is as described above.

These contents are ineffective in a case where the contents are less than the above stated ranges, while in a case where the contents are more than the stated ranges, the inhibitory force is too strong and secondary recrystallization becomes unstable. Therefore, the above ranges are used.

The balance of the chemical composition of the steel slab is Fe and inevitable impurities, also described herein as "being substantially Fe".

[Production Conditions]

A steel slab having the above suitable chemical compositions is subjected to heating and hot rolling according to known methods, and then subjected to cold rolling once or twice or more with intermediate annealing performed therebetween, to make a final cold-rolled sheet of a final sheet thickness. If necessary, hot-rolled sheet annealing can be performed after hot rolling.

The final cold-rolled sheet is subjected to primary recrystallization annealing, followed by application of an annealing separator according to our method and then final annealing. Final annealing may be performed by known methods including secondary recrystallization annealing followed by purification annealing at a higher temperature. For example, secondary recrystallization annealing should be held for 5 to 200 hours at a temperature of 800° C. or higher and 1100° C. or lower. In a case where the sheet is held within the above temperature region for the above time, secondary recrystallization annealing may be performed while raising the temperature for the subsequent purification annealing. Purification annealing can generally be performed at a maximum arrival temperature of about 1200° ° C., but purification can be further advanced if the maximum attainable temperature is 1210° C. and preferably 1230° C. or higher. As for the purification annealing time, it is preferable that the time for the temperature to reach 1200° C. or higher is 1 hour or more, and more preferably is 3 hours or more. There is particularly no upper limit to the maximum arrival temperature, but less than 1250° C. is preferred from the viewpoint of preventing coil shape defects. Similarly for the upper limit of the purification annealing time, the time for which the temperature is 1200° C. or more is preferably 30 hours or less and more preferably 20 hours or less.

After that, an insulating tension coating treatment can be applied, in which an insulating coating containing colloidal silica or similar material is further applied and baked while with flattening annealing. With this treatment process, a grain-oriented electrical steel sheet with excellent magnetic properties and film properties can be obtained. Magnetic domain refining treatment can also be performed as necessary by laser or electron beam.

Furthermore, in our production method, conventional methods may be used for any production conditions not described herein.

EXAMPLES

Example 1

A steel slab containing C: 0.06%, Si: 3.40%, Mn: 0.08%, Al: 0.006%, Sb: 0.020%, Ti: 0.010%, N: 0.003%, and Cr: 0.03%, with the balance being substantially Fe, was heated at 1250° C. for 40 minutes, subjected to hot rolling to a thickness of 2.0 mm, and then subjected to hot-rolled sheet annealing at 1000° C. for 60 s, followed by cold rolling by a tandem mill to obtain a steel sheet with a final sheet thickness of 0.23 mm. After decarburization annealing, the steel sheet was coated with an annealing separator, dried, and wound into a coil.

The annealing separator used was made by adding 2 parts of titanium oxide and 1 part of magnesium sulfate relative to 100 parts of MgO, which is the main agent, or by further adding the composite oxide $MnTa_2O_6$ or various oxides in three different concentrations and applied with 13 g/m$^2$ to both sides of the steel sheet.

Then, as final annealing, secondary recrystallization annealing was performed by increasing the temperature from 800° C. to 1100° C. at a rate of 10° C./h, followed by purification annealing at 1200° ° C. or higher for 10 hours with a maximum arrival temperature of 1230° C. After that, an insulating coating was applied, and after baking at 900° C. for 60 s, magnetic domain refining treatment was performed with electron beam irradiation while heat flattening.

The magnetic properties of the products thus obtained are listed in Table 2. The results of quantitative analysis of Ti, N, and C after removal of the coating from the steel sheet are also listed in the same table.

TABLE 2

| Composite oxide | Amount (Mass part) | $B_8$ (T) | $W_{17/50}$ (W/kg) | Ti (%) | N (%) | C (%) | Remarks |
|---|---|---|---|---|---|---|---|
| $FeTa_2O_6$ | 3 | 1.93 | 0.74 | <0.001 | <0.001 | <0.001 | Example |
| $MnNb_2O_6$ | 3 | 1.94 | 0.73 | <0.001 | <0.001 | <0.001 | Example |
| $Al_2Mo_3O_{12}$ | 3 | 1.93 | 0.73 | <0.001 | <0.001 | <0.001 | Example |

TABLE 2-continued

| Composite oxide | Amount (Mass part) | $B_8$ (T) | $W_{17/50}$ (W/kg) | Ti (%) | N (%) | C (%) | Remarks |
|---|---|---|---|---|---|---|---|
| $CaMoO_4$ | 3 | 1.93 | 0.73 | <0.001 | <0.001 | <0.001 | Example |
| $CaZrO_3$ | 3 | 1.93 | 0.72 | <0.001 | <0.001 | <0.001 | Example |
| $(Fe,Mn)Nb_2O_6$ | 3 | 1.94 | 0.73 | <0.001 | <0.001 | <0.001 | Example |
| $MnTa_6O_6$ | 1 | 1.92 | 0.74 | <0.001 | <0.001 | <0.001 | Example |
| $MnTa_6O_6$ | 2 | 1.94 | 0.72 | <0.001 | <0.001 | <0.001 | Example |
| $MnTa_6O_6$ | 5 | 1.94 | 0.72 | <0.001 | <0.001 | <0.001 | Example |
| $MnTa_6O_6$ | 8 | 1.93 | 0.72 | <0.001 | <0.001 | <0.001 | Example |
| $MnTa_6O_6$ | 10 | 1.93 | 0.73 | <0.001 | <0.001 | <0.001 | Example |
| $MnTa_6O_6$ | 15 | 1.91 | 0.76 | 0.003 | 0.002 | <0.001 | Comparative example |
| No addition | | 1.91 | 0.80 | 0.008 | 0.003 | 0.001 | Comparative example |

From the same table, it can be understood that an annealing separator containing the appropriate amount of composite oxide in accordance with our method, as described above, effectively purifies Ti and N, and as a result, improves magnetic properties.

Example 2

A slab containing C: 0.07%, Si: 3.28%, Mn: 0.07%, Al: 0.02%, N: 0.008%, S: 0.02%, and V: 0.01, with the balance being substantially Fe, was heated to a temperature of 1400° C., subjected to hot rolling to a sheet thickness of 2.2 mm, followed by cold rolling twice with intermediate annealing performed therebetween, at 1100° C. for 1 minute to a final sheet thickness of 0.23 mm. After the cold-rolled sheet was subjected to decarburization annealing, an annealing separator, to which 5 parts $CaMoO_4$ and 0.2 parts potassium borate relative to 100 parts of MgO was added, was applied with 11 g/m$^2$ to both sides of the steel sheet. As a comparative example, a steel sheet was also produced at the same time in the same way, except that $CaMoO_4$ was not used. Then, as final annealing, secondary recrystallization annealing was performed at a temperature of 820° C. maintained for 50 hours, followed by purification annealing for 5 hours in a dry $H_2$ atmosphere at various maximum arrival temperatures. An insulating coating was then applied, and the steel sheet was baked at 900° C. for 60 s while heat flattening. The magnetic properties of the products thus obtained are listed in Table 3. The results of quantitative analysis of V, N, and C after removal of the coating from the steel sheet are also listed in the same table.

TABLE 3

| $CaMoO_4$ Presence or absence | Maximum arrival temperature of purification (° C.) | $B_8$ (T) | $W_{17/50}$ (W/kg) | V (%) | N (%) | C (%) | Remarks |
|---|---|---|---|---|---|---|---|
| Present | 1150 | 1.93 | 0.77 | 0.001 | 0.001 | <0.001 | Example |
| | 1180 | 1.93 | 0.76 | 0.001 | 0.001 | <0.001 | Example |
| | 1210 | 1.93 | 0.75 | <0.001 | 0.001 | <0.001 | Example |
| | 1230 | 1.93 | 0.75 | <0.001 | 0.001 | <0.001 | Example |
| | 1250 | 1.93 | 0.74 | <0.001 | <0.001 | <0.001 | Example |
| Absent | 1150 | 1.92 | 0.82 | 0.009 | 0.003 | <0.001 | Comparative example |
| | 1180 | 1.92 | 0.82 | 0.009 | 0.002 | <0.001 | Comparative example |
| | 1210 | 1.92 | 0.82 | 0.009 | 0.002 | <0.001 | Comparative example |
| | 1230 | 1.92 | 0.81 | 0.008 | 0.002 | <0.001 | Comparative example |
| | 1250 | 1.92 | 0.81 | 0.008 | 0.002 | <0.001 | Comparative example |

From the same table, it can be understood that the purification of Vis further promoted by increasing the maximum arrival temperature of purification to 1210° C. or higher.

Example 3

Slabs comprising each composition listed in Table 4 were heated to 1400° C., subjected to hot rolling to a sheet thickness of 2.2 mm, and subjected to cold rolling twice with intermediate annealing performed therebetween, at 1050° C. for 2 minutes to obtain a final sheet thickness of 0.23 mm. After the cold-rolled sheet was subjected to decarburization annealing, an annealing separator, to which 3 parts by mass of $(Fe,Mn)Nb_2O_6$, 3 parts by mass of tin oxide and 2 parts by mass of titanium oxide relative to 100 parts by mass of MgO was added, was applied with 10 g/m$^2$ to both sides of the steel sheet and allowed to dry. As a comparative example, a steel sheet was also produced at the same time in the same way except that $(Fe,Mn)Nb_2O_6$ was not used. Thereafter, as final annealing, secondary recrystallization annealing was performed at a temperature of 820° ° C. maintained for 50 hours, followed by purification annealing at 1230° C. for 5 hours in a dry $H_2$ atmosphere. An insulating coating was then applied, and the steel sheet was baked at 900° C. for 60 s while heat flattening. The magnetic properties of the products thus obtained are listed in Table 4. The results of quantitative analysis of Nb, V, Ti, N, and C after removal of the coating from the steel sheet are also listed in the same table.

TABLE 4

| Steel sheet No. | Composition (%) | | | | | | | | | | | | | |
|---|---|---|---|---|---|---|---|---|---|---|---|---|---|---|
| | C | Si | Mn | Nb | Ti | V | Al | N | Se | S | P | Sb | Sn | Others |
| 1 | 0.04 | 3.16 | 0.22 | 0.003 | — | — | 0.007 | 0.003 | — | — | 0.008 | — | — | — |
| 2 | 0.02 | 3.27 | 0.08 | 0.010 | — | — | 0.004 | 0.003 | — | — | — | 0.005 | — | — |
| 3 | 0.06 | 3.36 | 0.13 | — | 0.005 | — | 0.018 | 0.009 | — | — | — | — | — | — |
| 4 | 0.07 | 3.48 | 0.08 | — | 0.020 | — | 0.033 | 0.011 | 0.019 | — | — | — | 0.010 | — |
| 5 | 0.07 | 3.44 | 0.08 | — | — | 0.010 | 0.024 | 0.009 | — | 0.021 | — | — | — | Ni: 0.01 |
| 6 | 0.06 | 3.23 | 0.06 | 0.006 | — | 0.018 | 0.021 | 0.007 | 0.018 | — | — | — | — | Cr: 0.03 |
| 7 | 0.01 | 3.43 | 0.09 | 0.004 | — | — | 0.018 | 0.008 | 0.011 | — | 0.020 | — | — | Cu: 0.09 |
| 8 | 0.09 | 3.29 | 0.06 | 0.004 | — | — | 0.016 | 0.008 | 0.018 | — | — | 0.030 | — | — |
| 9 | 0.06 | 2.24 | 0.08 | 0.004 | — | — | 0.026 | 0.007 | 0.026 | — | — | — | — | — |
| 10 | 0.06 | 3.80 | 0.07 | 0.004 | — | — | 0.023 | 0.007 | 0.015 | — | — | — | 0.030 | Ni: 0.01 |
| 11 | 0.05 | 3.31 | 0.03 | 0.004 | — | — | 0.019 | 0.005 | 0.02 | — | — | — | — | Te: 0.008 |
| 12 | 0.06 | 3.19 | 0.24 | 0.004 | 0.008 | — | 0.023 | 0.006 | — | — | 0.090 | — | — | — |
| 13 | 0.05 | 3.48 | 0.06 | 0.004 | — | — | 0.036 | 0.010 | — | — | — | — | — | Sn: 0.100 |
| 14 | 0.06 | 3.21 | 0.03 | 0.004 | — | — | 0.038 | 0.008 | 0.021 | 0.002 | — | — | — | Mo: 0.010 |
| 15 | 0.06 | 3.28 | 0.08 | 0.004 | — | — | 0.008 | 0.007 | 0.016 | 0.005 | 0.005 | — | — | Te: 0.0007 |
| 16 | 0.07 | 3.33 | 0.06 | 0.004 | — | — | 0.025 | 0.007 | 0.002 | 0.028 | — | — | — | — |
| 17 | 0.06 | 3.29 | 0.07 | 0.004 | — | — | 0.021 | 0.007 | 0.029 | — | 0.020 | — | 0.010 | Mo: 0.080 |
| 18 | 0.07 | 3.21 | 0.07 | 0.004 | — | — | 0.026 | 0.008 | 0.016 | — | 0.030 | 0.100 | 0.020 | Cu: 0.40, Cr: 0.38 |
| 19 | 0.07 | 3.30 | 0.06 | 0.004 | — | — | 0.019 | 0.006 | 0.021 | — | — | — | 0.080 | B: 0.0004, Ni: 1.37 |
| 20 | 0.06 | 3.46 | 0.08 | 0.004 | — | — | 0.026 | 0.008 | 0.020 | — | — | — | 0.005 | Cu: 0.33 |
| 21 | 0.07 | 2.95 | 0.06 | 0.004 | — | — | 0.039 | 0.008 | 0.021 | — | — | — | — | Bi: 0.002 |
| 22 | 0.06 | 3.29 | 0.08 | 0.004 | — | — | 0.022 | 0.007 | 0.006 | — | — | — | — | Bi: 0.040 |
| 23 | 0.06 | 3.21 | 0.08 | 0.004 | — | — | 0.013 | 0.006 | — | — | — | — | — | B: 0.0023 |
| 24 | 0.07 | 3.35 | 0.03 | 0.004 | — | — | 0.005 | 0.003 | 0.007 | — | — | — | — | B: 0.0002 |
| 25 | 0.07 | 3.34 | 0.07 | 0.004 | — | — | 0.011 | 0.005 | — | 0.006 | 0.040 | — | — | — |
| 26 | 0.04 | 3.16 | 0.22 | 0.003 | — | — | 0.007 | 0.003 | — | — | 0.008 | — | — | — |
| 27 | 0.02 | 3.27 | 0.08 | 0.010 | — | — | 0.004 | 0.003 | — | — | — | 0.005 | — | — |
| 28 | 0.06 | 3.36 | 0.13 | — | 0.005 | — | 0.018 | 0.009 | — | — | — | — | — | — |
| 29 | 0.07 | 3.48 | 0.08 | — | 0.020 | — | 0.033 | 0.011 | 0.019 | — | — | — | 0.010 | — |
| 30 | 0.07 | 3.44 | 0.08 | — | — | 0.010 | 0.024 | 0.009 | — | 0.021 | — | — | — | Ni: 0.01 |

| Steel sheet No. | $(Fe,Mn)Nb_2O_6$ presence or absence | $B_8$ (T) | $W_{17/50}$ (W/kg) | Product sheet purity analysis (%) | | | | | Remarks |
|---|---|---|---|---|---|---|---|---|---|
| | | | | Nb | Ti | V | N | C | |
| 1 | Present | 1.92 | 0.76 | <0.001 | <0.001 | <0.001 | <0.001 | <0.001 | Example |
| 2 | Present | 1.93 | 0.76 | <0.001 | <0.001 | <0.001 | <0.001 | <0.001 | Example |
| 3 | Present | 1.94 | 0.77 | <0.001 | <0.001 | <0.001 | <0.001 | <0.001 | Example |
| 4 | Present | 1.94 | 0.75 | <0.001 | <0.001 | <0.001 | <0.001 | <0.001 | Example |
| 5 | Present | 1.95 | 0.77 | <0.001 | <0.001 | <0.001 | <0.001 | <0.001 | Example |
| 6 | Present | 1.94 | 0.77 | <0.001 | <0.001 | <0.001 | <0.001 | <0.001 | Example |
| 7 | Present | 1.93 | 0.77 | <0.001 | <0.001 | <0.001 | <0.001 | <0.001 | Example |
| 8 | Present | 1.94 | 0.77 | <0.001 | <0.001 | <0.001 | <0.001 | <0.001 | Example |
| 9 | Present | 1.93 | 0.77 | <0.001 | <0.001 | <0.001 | <0.001 | <0.001 | Example |
| 10 | Present | 1.93 | 0.75 | <0.001 | <0.001 | <0.001 | <0.001 | <0.001 | Example |
| 11 | Present | 1.93 | 0.77 | <0.001 | <0.001 | <0.001 | <0.001 | <0.001 | Example |
| 12 | Present | 1.94 | 0.78 | <0.001 | <0.001 | <0.001 | <0.001 | <0.001 | Example |
| 13 | Present | 1.93 | 0.77 | <0.001 | <0.001 | <0.001 | <0.001 | <0.001 | Example |
| 14 | Present | 1.94 | 0.77 | <0.001 | <0.001 | <0.001 | <0.001 | <0.001 | Example |
| 15 | Present | 1.95 | 0.77 | <0.001 | <0.001 | <0.001 | <0.001 | <0.001 | Example |
| 16 | Present | 1.95 | 0.77 | <0.001 | <0.001 | <0.001 | <0.001 | <0.001 | Example |
| 17 | Present | 1.95 | 0.75 | <0.001 | <0.001 | <0.001 | <0.001 | <0.001 | Example |
| 18 | Present | 1.94 | 0.75 | <0.001 | <0.001 | <0.001 | <0.001 | <0.001 | Example |
| 19 | Present | 1.94 | 0.75 | <0.001 | <0.001 | <0.001 | <0.001 | <0.001 | Example |
| 20 | Present | 1.94 | 0.75 | <0.001 | <0.001 | <0.001 | <0.001 | <0.001 | Example |
| 21 | Present | 1.97 | 0.79 | <0.001 | <0.001 | <0.001 | <0.001 | <0.001 | Example |
| 22 | Present | 1.96 | 0.79 | <0.001 | <0.001 | <0.001 | <0.001 | <0.001 | Example |
| 23 | Present | 1.95 | 0.78 | <0.001 | <0.001 | <0.001 | <0.001 | <0.001 | Example |
| 24 | Present | 1.95 | 0.78 | <0.001 | <0.001 | <0.001 | <0.001 | <0.001 | Example |
| 25 | Present | 1.95 | 0.77 | <0.001 | <0.001 | <0.001 | <0.001 | <0.001 | Example |
| 26 | Absent | 1.92 | 0.80 | 0.003 | <0.001 | <0.001 | 0.002 | <0.001 | Comparative example |
| 27 | Absent | 1.92 | 0.80 | 0.090 | <0.001 | <0.001 | 0.004 | <0.001 | Comparative example |
| 28 | Absent | 1.94 | 0.81 | <0.001 | 0.004 | <0.001 | 0.002 | <0.001 | Comparative example |
| 29 | Absent | 1.94 | 0.80 | <0.001 | 0.020 | <0.001 | 0.002 | <0.001 | Comparative example |
| 30 | Absent | 1.94 | 0.81 | <0.001 | <0.001 | 0.010 | 0.002 | <0.001 | Comparative example |

As is clear from the same table, the purification is sufficient, and good values for magnetic properties can be obtained for all steel sheets with chemical compositions within the prescribed ranges in our method under a set of conditions including using an annealing separator containing a prescribed amount of $(Fe,Mn)Nb_2O_6$.

The invention claimed is:

1. A method of producing a grain-oriented electrical steel sheet, the method comprising: subjecting a slab for grain-oriented electrical steel sheets to heating, hot rolling, cold rolling once or twice or more with intermediate annealing performed therebetween, primary recrystallization annealing followed by application of an annealing separator, and then final annealing, wherein the slab for grain-oriented electrical steel sheets comprises a chemical composition containing C in an amount of 0.01 mass % to 0.09 mass %, Si in an amount of 2.00 mass % to 4.00 mass %, Mn in an amount of 0.03 mass % to 0.25 mass %, and at least one selected from a group consisting of Nb, V and Ti in a total amount of 0.002 mass % to 0.025 mass %, with the balance being Fe and inevitable impurities, wherein the annealing separator contains MgO as a main agent and 1 to 10 parts by mass of a composite oxide, relative to 100 parts by mass of MgO, the composite oxide containing at least one selected from the group consisting of $(Fe_x,Mn_{1-x})_2Mo_3O_{12}$, $Al_2(MoO_4)_3$, $(Fe_x,Mn_{1-x})(Ta_y,Nb_{1-y})O_3$, $Al_2Zr_3O_9$, $FeTa_2O_6$, $MnNb_2O_6$, $(Fe,Mn)Nb_2O_6$, $MnTa_2O_6$, $CaZrO_3$ and $Al_2Mo_3O_{12}$, where x and y take any values in the range of 0 to 1.

2. The method of producing a grain-oriented electrical steel sheet according to claim 1, wherein a maximum arrival temperature in the final annealing is 1210° C. or higher.

3. The method of producing a grain-oriented electrical steel sheet according to claim 1, wherein the chemical composition further contains at least one selected from a group consisting of Al: 0.004 mass % to 0.040 mass %, N: 0.002 mass % to 0.010 mass %, S: 0.002 mass % to 0.030 mass %, Se: 0.002 mass % to 0.030 mass %, Ni: 0.01 mass % to 1.50 mass %, Cr: 0.01 mass % to 0.50 mass %, Cu: 0.01 mass % to 0.50 mass %, P: 0.005 mass % to 0.100 mass %, Sb: 0.005 mass % to 0.100 mass %, Sn: 0.005 mass % to 0.100 mass %, Bi: 0.001 mass % to 0.050 mass %, Mo: 0.005 mass % to 0.100 mass %, B: 0.0002 mass % to 0.0025 mass %, and Te: 0.0005 mass % to 0.0100 mass %.

4. The method of producing a grain-oriented electrical steel sheet according to claim 2, wherein the chemical composition further contains at least one selected from a group consisting of Al: 0.004 mass % to 0.040 mass %, N: 0.002 mass % to 0.010 mass %, S: 0.002 mass % to 0.030 mass %, Se: 0.002 mass % to 0.030 mass %, Ni: 0.01 mass % to 1.50 mass %, Cr: 0.01 mass % to 0.50 mass %, Cu: 0.01 mass % to 0.50 mass %, P: 0.005 mass % to 0.100 mass %, Sb: 0.005 mass % to 0.100 mass %, Sn: 0.005 mass % to 0.100 mass %, Bi: 0.001 mass % to 0.050 mass %, Mo: 0.005 mass % to 0.100 mass %, B: 0.0002 mass % to 0.0025 mass %, and Te: 0.0005 mass % to 0.0100 mass %.

* * * * *